United States Patent [19]

Yokoyama

[11] 4,449,071

[45] May 15, 1984

[54] FLUORESCENT LAMP DEVICE

[75] Inventor: Nobuo Yokoyama, Yokohama, Japan

[73] Assignee: Tokyo Shibaura Denki Kabushiki Kaisha, Kawasaki, Japan

[21] Appl. No.: 452,458

[22] Filed: Dec. 23, 1982

Related U.S. Application Data

[63] Continuation of Ser. No. 239,466, Mar. 2, 1981, abandoned.

[30] Foreign Application Priority Data

Mar. 13, 1980 [JP] Japan ..... 55-31850
Mar. 13, 1980 [JP] Japan ..... 55-31851

[51] Int. Cl.[3] ..... H01J 7/44

[52] U.S. Cl. ..... 315/53; 315/58; 315/62; 315/112; 313/607; 313/634; 313/234; 313/493

[58] Field of Search ..... 315/53, 59, 58, 61, 315/62, 112, 118; 313/201, 607, 220, 634, 234, 493

[56] References Cited

U.S. PATENT DOCUMENTS

| | | | |
|---|---|---|---|
| 2,301,670 | 11/1942 | Abadie | 315/53 |
| 2,504,594 | 4/1950 | Schouwstra et al. | 315/53 |
| 4,163,176 | 7/1979 | Cohen et al. | 315/53 |
| 4,173,730 | 11/1979 | Young et al. | 315/53 |
| 4,270,071 | 5/1981 | Morton | 315/62 |

*Primary Examiner*—Harold Dixon
*Attorney, Agent, or Firm*—Oblon, Fisher, Spivak, McClelland & Maier

[57] ABSTRACT

A fluorescent lamp device including an outer tube containing a fluorescent lamp therein, a connection tube connected to one end of the outer tube, a cap containing a glow starter and a condenser connected to the other end of the outer tube, and a base member connected to the connection tube. The base member contains a ballast member including a thermistor and a thermal adjustment member having a plurality of radiation fins, which are connected electrically and thermally through a conductive plate.

7 Claims, 5 Drawing Figures

FLUORESCENT LAMP DEVICE

This is a continuation of application Ser. No. 239,466, filed Mar. 2, 1981, now abandoned.

BACKGROUND OF THE INVENTION

1. Field of the Invention

This invention relates to a fluorescent lamp device having an incandescent lamp base.

2. Description of the Prior Art

A fluorescent lamp is widely used for its lighting efficiency in comparison with an incandescent lamp. So it is advantageous to use a fluorescent lamp instead of an incandescent lamp from the standpoint of saving electric power during times of severe energy crisis.

However, a fluorescent lamp is generally straight or annularly shaped and further generally has its own shaped base structure at the ends thereof. Additionally, it is generally necessary to include a glow starter and a ballast to light a fluorescent lamp.

Consequently, fluorescent lamps cannot be directly coupled to an incandescent lamp base because of the above reasons.

There have been a few proposed fluorescent lamp devices having an incandescent lamp base, for example as shown in U.S. Pat. No. 3,953,761. But in such a lamp device, a large ballast is disposed in the center of the device, such that it is impossible to dispose a conventional ballast in an incandescent lamp base. However, if a ballast is constructed small and light, it would be possible to dispose such ballast in an incandescent lamp base.

Such a ballast, which uses a positive temperature coefficient characteristic thermistor, is known from Japanese Utility Model No. 1,018,720. However, this thermistor ballast has a tendency to increase its resistance value as its temperature rises. As a result, as such a termistor is heated to a predetermined temperature, its resistance value rapidly becomes large.

In such a case, the fluorescent lamp soon stops lighting since it is not possible to supply the lamp filaments with enough current to maintain an electric discharge.

Therefore it has been impossible to use such a thermistor ballast for application to a fluorescent lamp device of the above-noted type.

SUMMARY OF THE INVENTION

Accordingly, one object of this invention is to provide a small and compact fluorescent lamp device having an incandescent lamp base.

Another object of this invention is to provide a fluorescent lamp device using a positive temperature characteristic thermistor.

Yet another object of this invention is to provide a fluorescent lamp device provided with a thermal adjustment member connected to the thermistor.

A further object of this invention is to provide a fluorescent lamp which is simple in design, easy to manufacture and efficient and reliable in operation.

These and other objects are achieved by providing a new and improved fluorescent lamp device according to the invention, including a cylindrical outer tube; a fluorescent lamp having two ends each provided with a base, the lamp being disposed in the outer tube; a cylindrical connection tube connected to one end of the outer tube; a cap member containing a glow starter and a capacitor, fixed to the other end of the outer tube; and a base member containing a ballast member and fixed to the connection tube.

In a particularly advantageous embodiment, the ballast member includes a spring, a first conductive plate, a positive temperature coefficient thermistor, a second conductive plate, and a thermal adjustment element coupled to the thermistor via the second conduction plate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
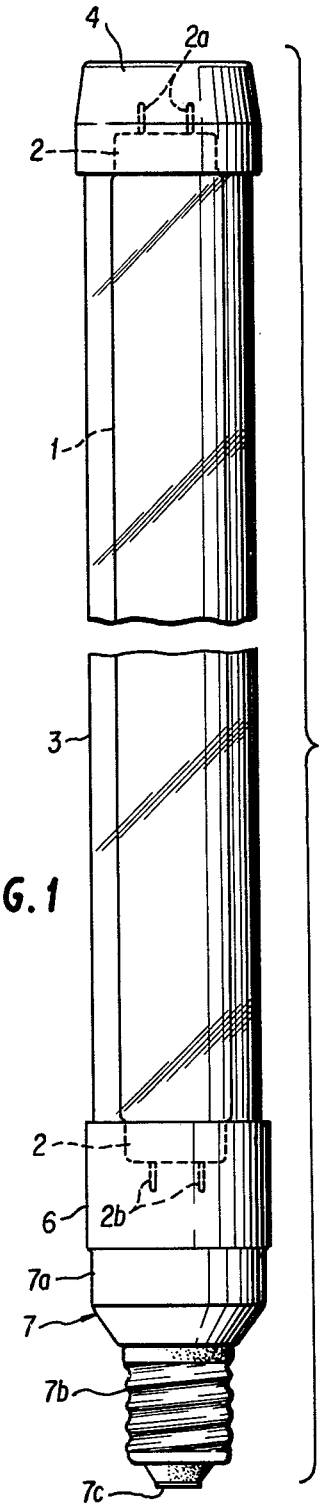
FIG. 1 is a schematic elevational view of a fluorescent lamp device constructed in accordance with the present invention.
Figure 2:
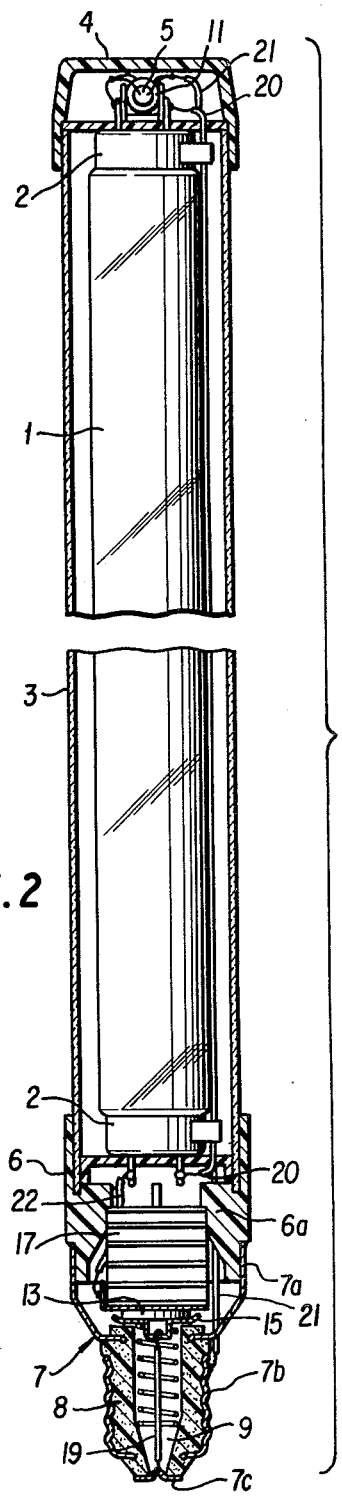
FIG. 2 is a cross-sectional view of the lamp shown in FIG. 1.

Referring now to the drawings, wherein like reference numerals designate identical or corresponding parts throughout the several views, and more particularly to FIG. 1 and FIG. 2 thereof, there is shown a fluorescent lamp 1 provided with base 2, 2 at both ends thereof. Lamp 1 is disposed in a cylindrical outer tube 3 made of transparent polycarbonate resin. A cap 4 is provided at one end of the outer tube 3 and a glow starter 5 is contained therein. At the outer end of the outer tube 3 a connection tube 6 connects the outer tube 3, with a base member 7. The base member 7 is an Edison type screw base consisting of a cylindrical straight part *7a*, a screw part *7b* and a terminal part *7c*. There is filled an insulating material 8 in the surface of the screw part *7b*, consequently there is formed a conductive hollow 9 leading to the terminal part *7c* surrounded with the insulating material 8.

Figure 3:
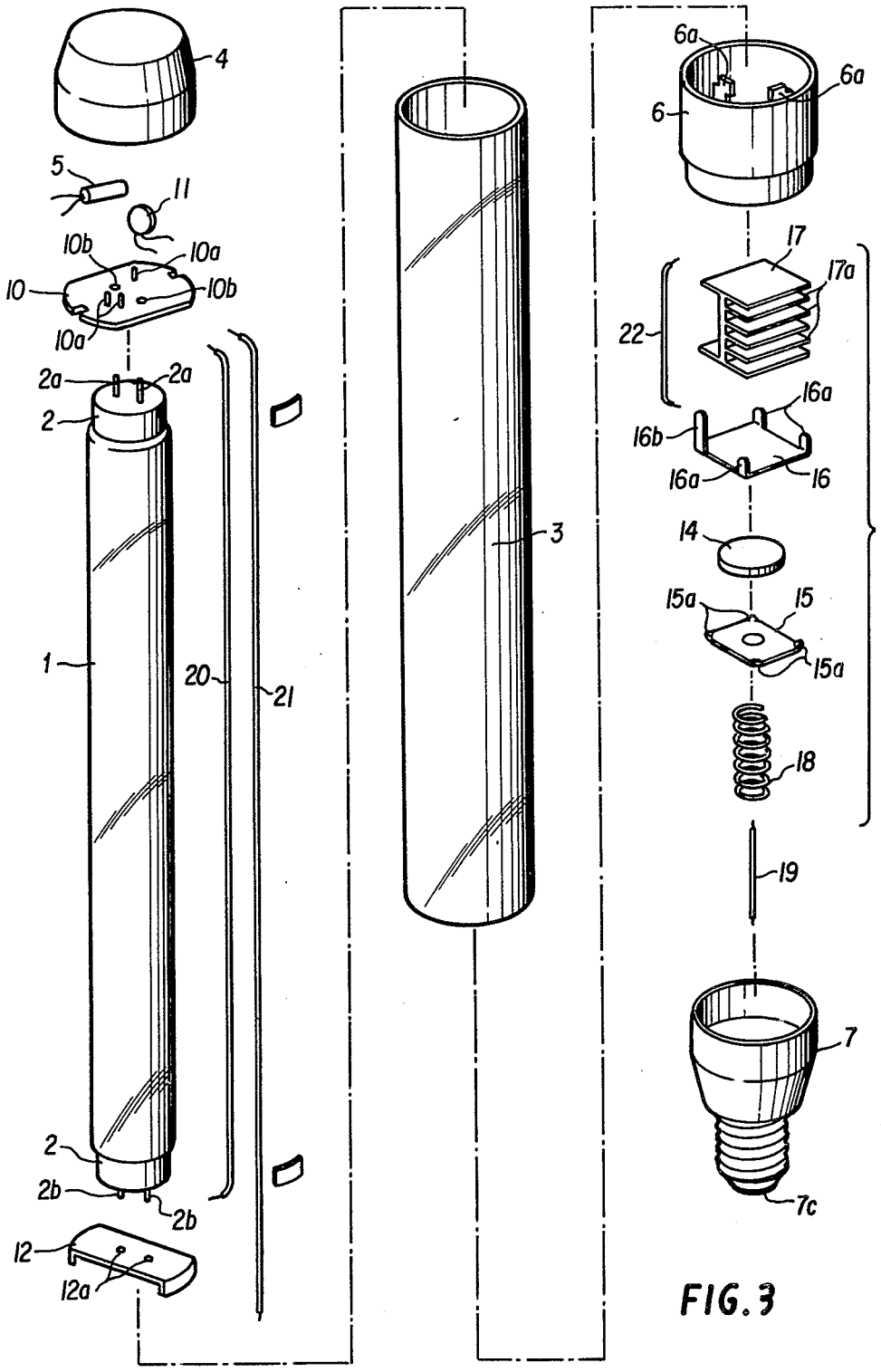
FIG. 3 is an exploded perspective view of a fluorescent device constructed in accordance with the present invention.

Referring to FIG. 3, the reference number designation 10 refers to a first holding plate having projections *10a* to hold the glow starter 5 and a condensor 11. Plate 10 further has holes *10b, 10b* which accomodate and fix pins *2a, 2a* of the base 2. Reference number designation 12 refers to a second holding plate having holes *12a, 12a* which accommodate and fix the other pins *2b, 2b* of the base 2.

Reference number 13 refers to a ballast element comprising a positive characteristic thermistor 14, a first conductive plate 15, a second conductive plate 16, a thermal adjustment member 17 and a spring 18.

Figure 5:
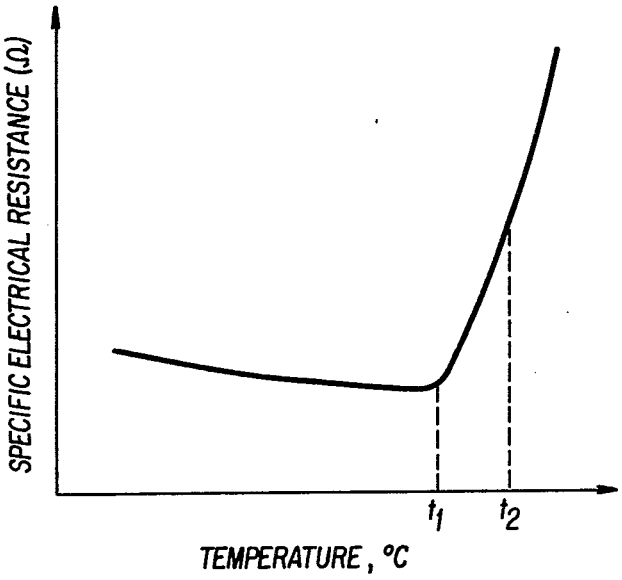
FIG. 5 is a graph illustrating the relation between the temperature and the resistance value of the thermister.

The positive temperature coefficient characteristic thermistor (hereinafter called only "thermistor") 14 has its thermal-specific electric resistance characteristic shown in FIG. 5. Thermistor 14 is disposed in the base member 7.

The thermistor 14 is a compound of barium titanate including at least one element selected from the group consisting of yttrium, lanthanum, cerium, niobium, tantalum, bismuth, antimony and lead. The thermistor is formed in the shape of a disk having a thickness of about 2.5 mm. The thermistor 14 is sandwiched in between the first conductive plate 15 and the second conductive plate 16. The first conductive plate 15 has four upturned corners 15*a* . . . thereof, so movememt of the thermistor 14 is stopped by the upturned corners 15*a*.

On the other hand, the second conductive plate 16 has three projections 16*a* . . . and a high projection 16*b* at the corner thereof. The thermal adjustment member 17 is made of aluminium on which is disposed an anti-corrosive agent on the surface thereof. Member 17 is mounted on the second conductive plate 16 and is fixed to the second conductive plate 16 by bending the three projections 16*a* . . . on the base of the thermal adjustment member 17. Moreover, the thermal adjustment member 17 has plurality of radiation fins 17*a* . . . operating to radiate heat from the thermistor 14.

The spring 18 is disposed in the hollow 9. So the first conductive plate 15, the thermistor 14, the second conductive plate 16 and the thermal adjustment member 17 are always being pushed upwardly by the spring action of the spring 18. Thus, the top edge of the thermal adjustment member 17 is stopped by ribs 6*a* . . . which are formed in the surface of the connection tube 6. Reference number designation 19 refers to a lead wire to connect electricaly the first conductive plate 15 and the terminal part 7*c* of the base member 7. Conductors 20, 21 are disposed along the surface of the fluorescent lamp 1. Conductor 20 connects one of pins 2*b* and one of the lead wire of the glow starter 5 and the condenser 11. The other lead wire of the glow starter 5 and the condenser 11 is connected to one of pins 2*a*. The other conductor 21 connects the other pin 2*a* and the base member 7. Moreover, a conductor 22 connects the high projection 16*b* of the second conductive plate 15 and the remained pin 2*b* of the base 2 by welding.

Figure 4:
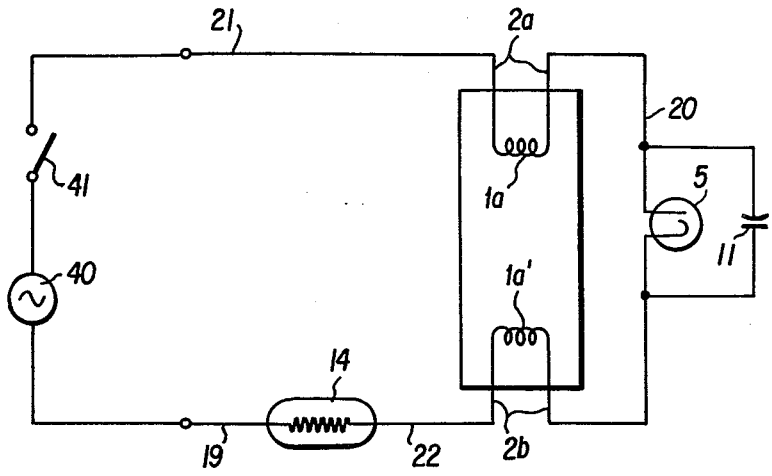
FIG. 4 is a schematic diagram of an electric circuit embodying the present invention.

According to above described construction, a schematic diagram of electric circuit is shown in FIG. 4. Namely, a filament 1*a*' of the fluorescent lamp 1 is connected to the thermistor 14 and the glow starter 5 and the condenser 11 in series. A filament 1*a* of the fluorescent lamp is connected to the power source 40 by way of the switch 41 and the glow starter 5 and the condenser 11. Therefore, the fluorescent lamp 1 and the glow starter 5 and the condenser 11 are connected in parallel during the lighting with each other.

In such an electric circuit, when a switch 41 is closed a current flows through the filaments 1*a*, 1*a* and the glow starter 5. So, owing to the well known operation of the glow starter 5, the fluorescent lamp 1 begins to light. After lighting, the well known negative characteristic for current-voltage ensues. But the fluorescent lamp 1 itself cannot control the increase of the current. To control the lamp current, it is necessary to have the thermistor 14.

When using this thermistor 14, immediately after lighting the resistance value of the thermistor 14 is low because the temperature of the thermistor 14 is low. Therefore, a large current commences flowing through the filament 1*a*, 1*b*, and it is easy to maintain discharge of the fluorescent lamp 1 because the amount of the electron emission released from the filament 1*a*, 1*b* increases. During this time the thermistor 14 is heated and its temperature maintained between t1° C.~t2° C. in FIG. 5. Consequently stable lighting of the fluorescent lamp continues.

But when the power source exceeds its normal value, the current value is up too, so that the thermister 14 is heated more and more and finally is temperature is over the t1° C. In such a case the lighting of the fluorescent lamp will soon stop because the resistance of the thermistor 14 increases. So the current flowing to the filament 1*a*, 1*b* decreases, and the fluorescent lamp 1 cannot continue lighting.

But owing to present invention, the thermistor 14 is connected to the thermal adjustment member 17 through the second conductive plate 16, which conducts excess heat from the thermistor 14 to the thermal adjustment member 17. The thermal adjustment member 17 radiates heat by way of its radiation fins 17*a*.

On account of the existence of the thermal adjustment member 17, the temperature of the thermistor 14 is always controlled to be under the predetermined temperature t2° C. Consequently, the resistance value of the thermistor 14 is always controlled to a desirable value, so that stable lighting of the fluorescent lamp 1 is maintained.

Moreover, the thermister 14 is always being pushed against the thermal adjustment member 17 by the spring action of the spring 18, so that reliable thermal conduction from the thermistor 14 to the thermal adjustment member 17 is achieved.

Moreover, the thermal adjustment member 17 has a plurality of radiation fins 170 . . . , so it is easy to radiate heat from the thermal adjustment member 17.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fluorescent lamp device comprising:

a cylindrical outer tube;

a fluorescent lamp, having two ends including a base at each end thereof, disposed in said outer tube, each of said bases including a pair of electrodes for making electrical connection to said lamp;

a cylindrical connection tube connected to one end of the outer tube;

a cap member, containing a parallel combination of a glow starter and a condenser therein, fixed to the other end of the said outer tube;

a base member fixed to said connection tube;

a ballast member contained in said base member, said ballast comprising, a spring, a first conductive plate pressed against by said spring, a thermistor, a second conductive plate, said thermistor disposed between said first and second conductive plates, a thermal adjustment member;

wherein said thermistor and said thermal adjustment member are thermally and electrically connected through said second conductive plate;

said parallel combination of said glow starter and said condenser connected in series circuit with said pairs of electrodes and said thermistor; and a pair of conductors coupled from said one end of said lamp and from said base member to the other end of said lamp and to said parallel combination of said glow starter and said condenser to complete said series circuit.

2. A fluorescent lamp device as in claim 1 wherein said thermistor exhibits a positive temperature characteristic coefficient.

3. A fluorescent lamp device as in claim 1 wherein said thermal adjustment member comprises:

a plurality of radiation fins.

4. A fluorescent lamp device as in claim 3, wherein said second conductive plate comprises:

projections for fixing said second conductive plate to said thermal adjustment member and for making an electrical connection by means of an electrical conductor from said second conductive plate to a selected base of said fluorescent lamp.

5. A fluorescent lamp device as in claim 4, wherein said thermal adjustment member is fixed to said second conductive plate by bending of said projections of said second conductive plate.

6. A fluorescent lamp device as in claim 1, wherein said second conductive plate comprises:

projections for fixing said second conductive plate to said thermal adjustment member and for making an electrical connection by means of an electrical conductor from said second conductive plate to a selected base of said fluorescent lamp.

7. A fluorescent lamp device as in claim 6, wherein said thermal adjustment member is fixed to said second conductive plate by bending of said projections of said second conductive plate.

* * * * *